US007563211B1

(12) United States Patent
Wu

(10) Patent No.: US 7,563,211 B1
(45) Date of Patent: Jul. 21, 2009

(54) MULTI-FUNCTION EXERCISE APPARATUS

(75) Inventor: San Ching Wu, Taipei County (TW)

(73) Assignee: Super Made Products Co., Ltd., Taipei (TW)

( * ) Notice: Subject to any disclaimer, the term of this patent is extended or adjusted under 35 U.S.C. 154(b) by 0 days.

(21) Appl. No.: 12/071,952

(22) Filed: Feb. 28, 2008

(51) Int. Cl.
*A63B 21/02* (2006.01)
*A63B 21/045* (2006.01)

(52) U.S. Cl. ..... 482/123; 482/127; 482/130

(58) Field of Classification Search ..... 482/72, 482/123, 135, 140, 142, 130
See application file for complete search history.

(56) References Cited

U.S. PATENT DOCUMENTS 5,007,632 A * 4/1991 Wilkinson ..... 482/72
5,295,935 A * 3/1994 Wang ..... 482/130
5,752,901 A * 5/1998 Lee ..... 482/130
5,772,563 A * 6/1998 Lin ..... 482/140
6,090,023 A * 7/2000 Liu ..... 482/140
6,220,995 B1 * 4/2001 Chen ..... 482/140
6,966,871 B2 * 11/2005 Parmater ..... 482/140
7,326,159 B2 * 2/2008 Rong ..... 482/140
7,381,171 B2 * 6/2008 Chen ..... 482/140
2006/0183606 A1 * 8/2006 Parmater ..... 482/72
2008/0076649 A1 * 3/2008 Chen ..... 482/140
2008/0242519 A1 * 10/2008 Parmater ..... 482/72

* cited by examiner

*Primary Examiner*—Loan H Thanh
*Assistant Examiner*—Victor K Hwang
(74) *Attorney, Agent, or Firm*—Bacon & Thomas, PLLC

(57) ABSTRACT

The present invention pertains to a multi-function exercise apparatus which is comprised of a support platform, front and rear frames, footboards, a sliding seat assembly, spring devices and a seat back. Particularly, the sliding seat assembly is mounted on the platform and has the spring devices installed at both sides thereof. Each spring device consists of a spring, a first stem upwardly attached to the seat back and a second stem downwardly secured to the sliding seat assembly, thereby generating a resistant force while propping against the seat back in order to apply the sit-ups performance and synchronize the abdominal exercise with the upper and lower torsos.

6 Claims, 8 Drawing Sheets

MULTI-FUNCTION EXERCISE APPARATUS

BACKGROUND OF THE INVENTION (a) Field of the Invention

The present invention relates to equipments for physical exercise, in particular to a multi-function exercise apparatus for training the abdominal regions, thighs and arms.

(b) Description of the Prior Art

Generally, various types of exercise equipments have been proposed for different exercise motions, for instance of the running machine, the bicycle rider, the sliding machine or other gym apparatuses for fitness and muscle exercises. Most of those equipments in the market usually concentrate on the weight training of the arms or the strength training of the thighs, and fewer appropriative apparatuses are especially designed for exercising the abdominal regions of the body. However, neither the above training apparatuses nor the particular equipments simultaneously provide with the sit-ups performance in time of exercising the upper or lower torsos, thus limiting the training scope.

SUMMARY OF THE INVENTION

Therefore, the object of the present invention is to indicate a multi-function exercise apparatus including the concatenation of the sliding seat assembly, spring devices and the seat back in order to provide with the sit-ups exercise while training thighs and arms.

Another object of the present invention is to provide the apparatus having the spherical rotors disposed between the seat back for an attainment of the massage while being supine thereon.

The advantages of the present invention over the known prior arts will become more apparent to those of ordinary skilled in the art upon reading the following descriptions in junction with the accompanying drawings.

DETAILED DESCRIPTION OF THE PREFERRED EMBODIMENTS

Figure 1:
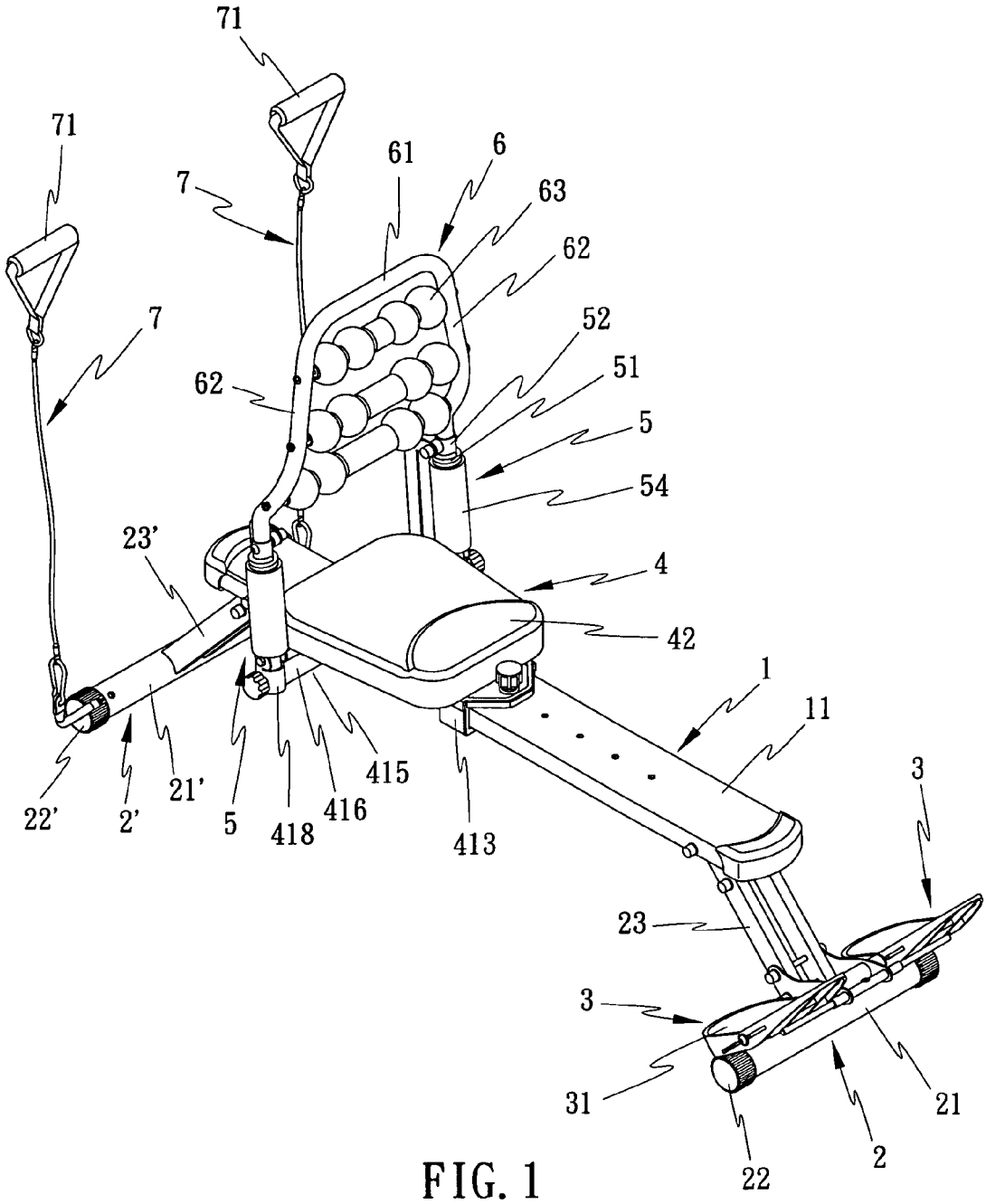
FIG. 1 is a perspective view showing a multi-function exercise apparatus of the present invention.
Figure 2:
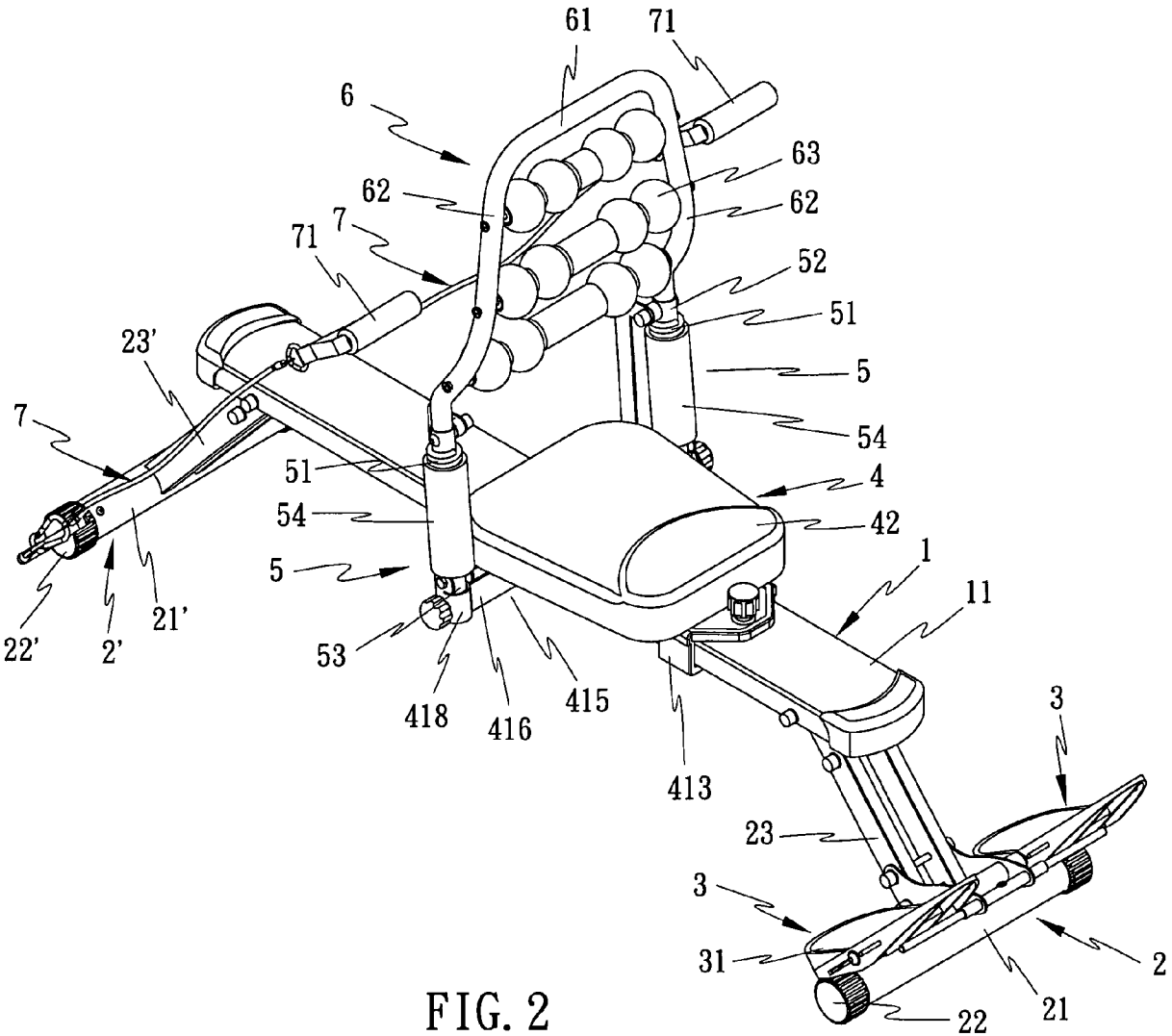
FIG. 2 is a schematic view showing the sliding seat assembly moved forward on the support platform.
Figure 3:
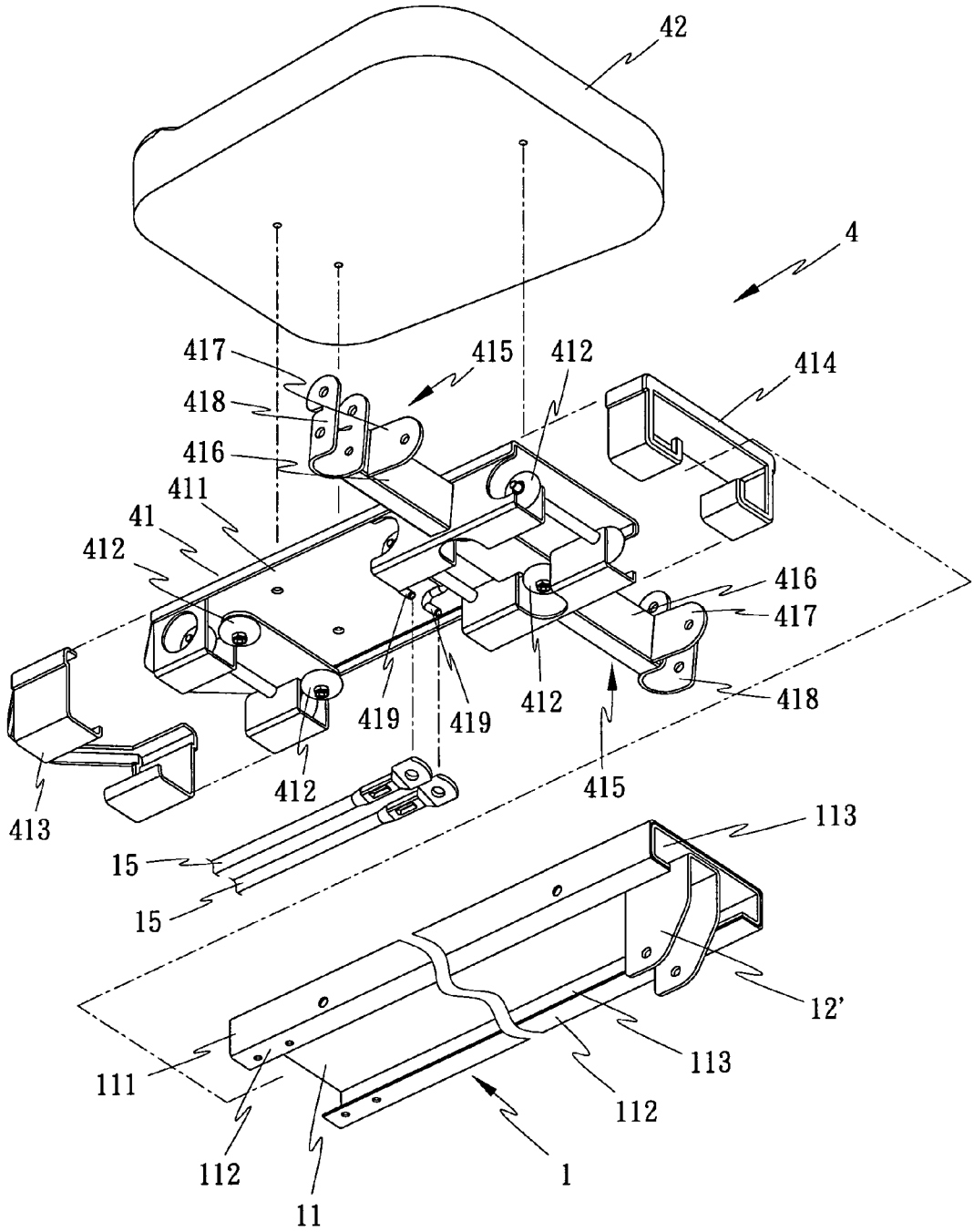
FIG. 3 is an exploded view showing the partial sliding seat assembly.

Referring to FIG. 1, a multi-function exercise apparatus of the present invention comprises a support platform 1, a respective front frame 2 and a rear frame 2', a pair of footboards 3, a sliding seat assembly 4, two spring devices 5 and a seat back 6; wherein, referring to FIG. 3, the support platform 1 is comprised of a rectangle base 11, two side walls 111 affixed to both sides of the rectangle base 11 and each inwardly attached to a side board 112, so that an interior channel 113 is further wrapped by the base 11, side walls 111 and the side boards 112. Furthermore, referring to both FIGS. 6 and 7, a front latch piece 12 and a rear latch piece 12' are separately mounted inside the interior channel 113 and located at both ends of the support platform 11; wherein, a pulley assembly 13 is disposed on the front latch piece 12 and a fixed portion 14 is located on the rear latch piece 12'; further, at least one tension cord 15 with its end connects to the fixed portion 14, thence around the pulley assembly 13, and then attaches to the sliding seat assembly 4 (also shown in FIG. 3).

Figure 6:
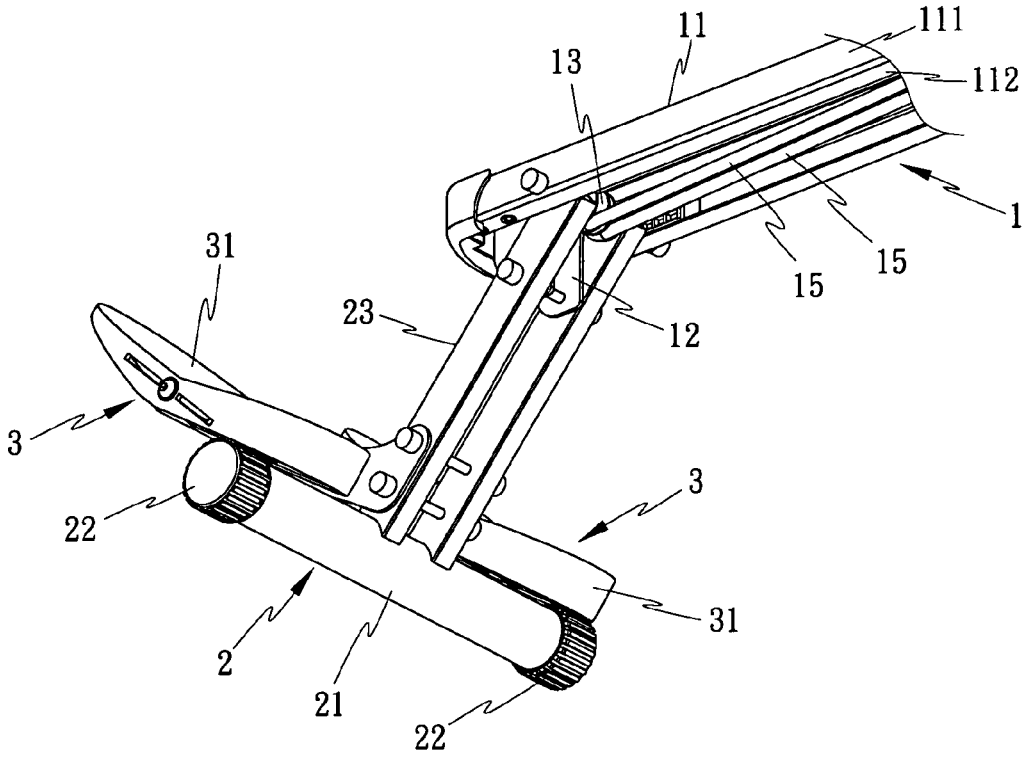
FIG. 6 is a perspective view showing the underside of the front frame.
Figure 7:
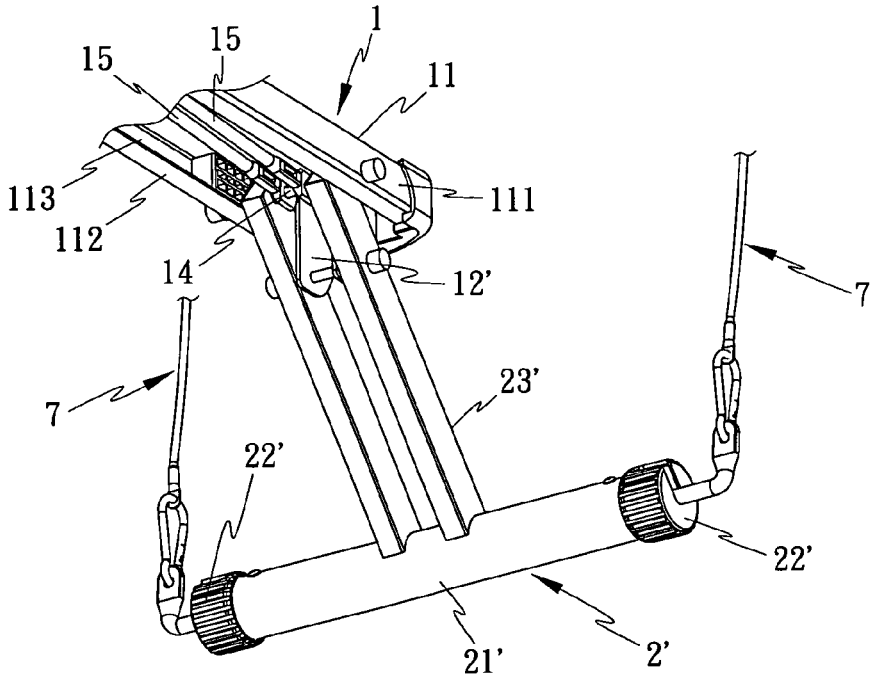
FIG. 7 is a perspective view showing the underside of the rear frame.

Still, referring to FIGS. 6 and 7, the front frame 2 has a front shaft 21 and two front slid-resistant tubes 22 disposed on both sides of the shaft 21; a front bridge 23 with one end is pivoted to the front frame 2 and with the other end is upwardly fastened to the front latch piece 12, so that the front frame 2 is engaged to the sliding seat assembly 1 for maintaining a certain height. Relatively, the rear frame 2' has the same concatenation of a rear shaft 21', two rear slid-resistant tubes 22' and a rear bridge 23'. In additionally, the pair of footboards 3 shown in FIG. 1 has a pedal 31 disposed on the front frame 2, and it is noted that any appropriate forms or configurations are allowable in the present invention.

Figure 4:
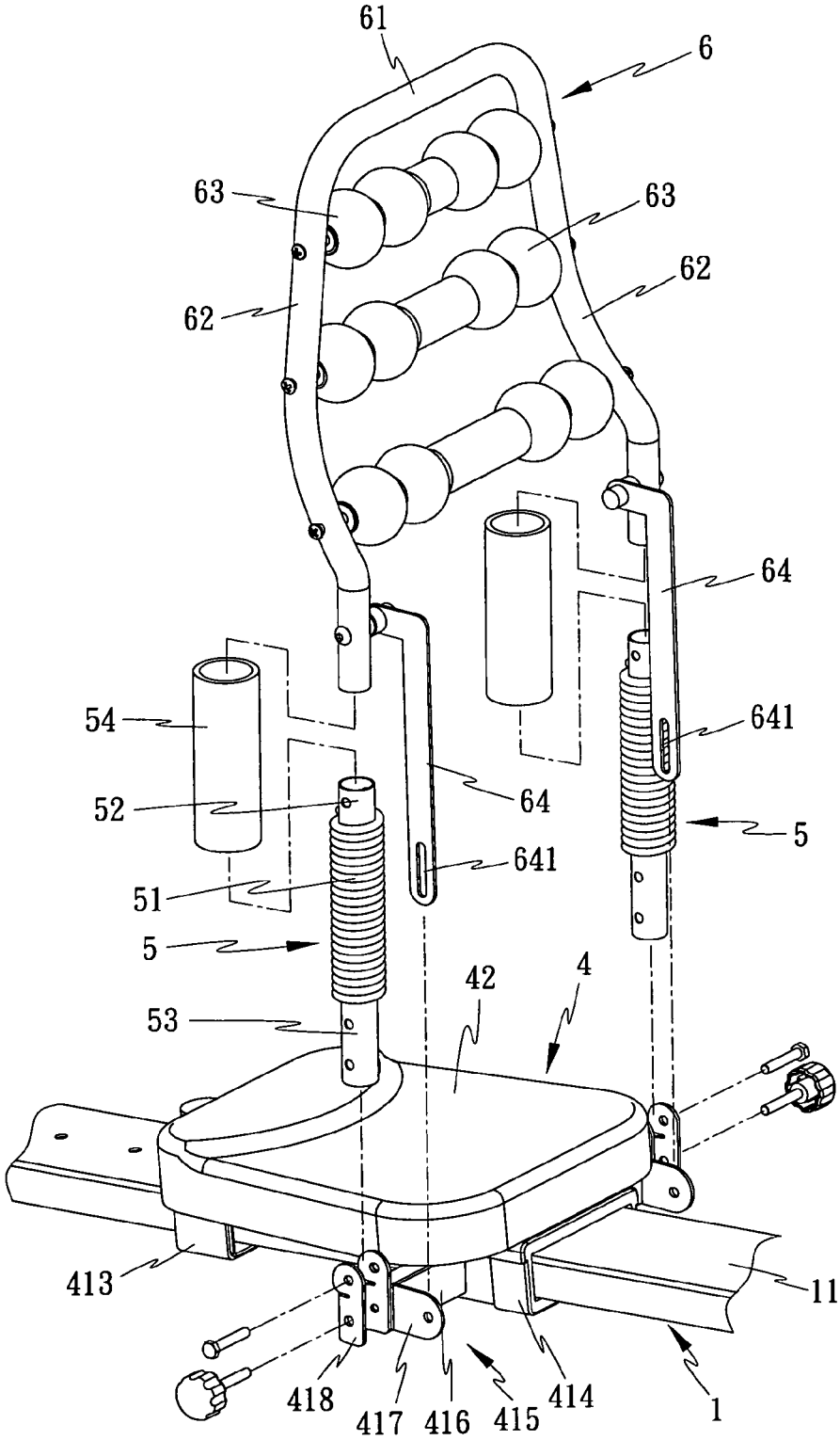
FIG. 4 is an exploded view showing the seat back and the sliding seat assembly.

Referring to FIGS. 3 and 4, the sliding seat assembly 4 has a sliding section 41 slidingly mounted to the support platform 1 and a seat cushion 42 fastened to the sliding section 41; wherein, the sliding section 41 provides with a sliding base 411 mounted on the support platform 1, a plurality of wheels 412 disposed on the underside thereof for embedding within the interior channel 113 and a front and rear sleeves 413, 414 respectively pivoted to both ends thereof; furthermore, a fastening section 415 disposed on the sliding base 411 includes two separate protrusions 416 extending from both sides of the base 411, and each protrusion 416 has a pivotal plate 417 disposed thereon and a U-shaped pivotal socket 418 connected to an outer edge thereof, where the spring device 5 can installed. Furthermore, a hook assembly 419 is also disposed at the underside of the sliding base 411 for suspending the at least tension cord 15 thereon and the cord 15 further drives the sliding section 41 going forward.

Figure 5:
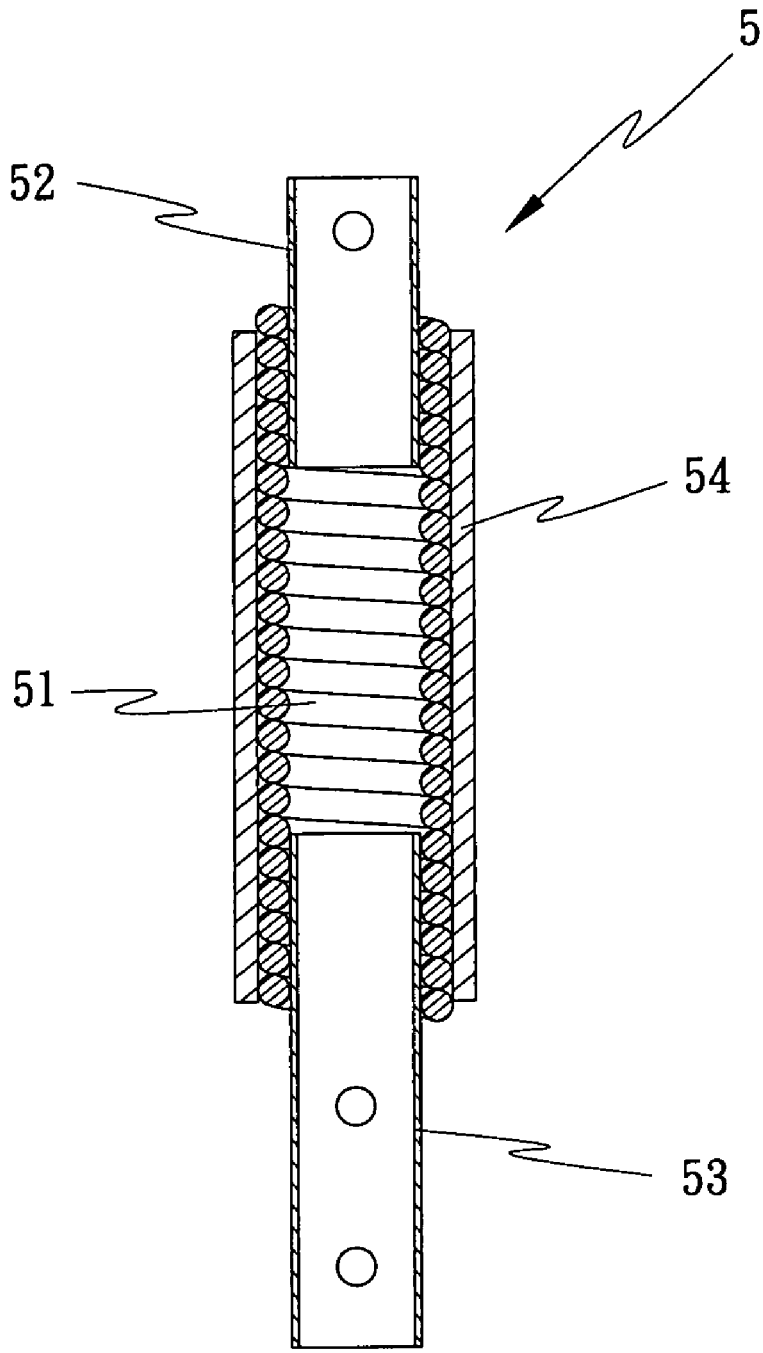
FIG. 5 is a cross sectional view showing the spring device.

Referring to FIGS. 4 and 5, each of two spring devices 5 further comprises a spring 51, a first stem 52 affixed to a top end of the spring 51 and a second stem 53 attached to a lower end thereof; each of the spring devices 5 has a shield 54 disposed around an outer peripheral thereof to prevent from nipping user's fingers in use. Furthermore, the two spring devices 5 are respectively secured to both sides of the sliding seat assembly 4 by means of the second stem 53 connected to the pivotal socket 418.

Still Referring to FIG. 4, the seat back 6 consists of a bracket 61 presented in a "ᒥ" contour, two arms 62 of the bracket 61 separately attached to the first stems 52 of the spring devices 5, a plurality of spherical rotors 63 are mounted between the two arms 62 and two respective braces 64 fastened to bottoms of the two arms 62; each brace 64 further forms a slot 641 at its distal end so as to contact with the pivotal plate 417.

Figure 8:
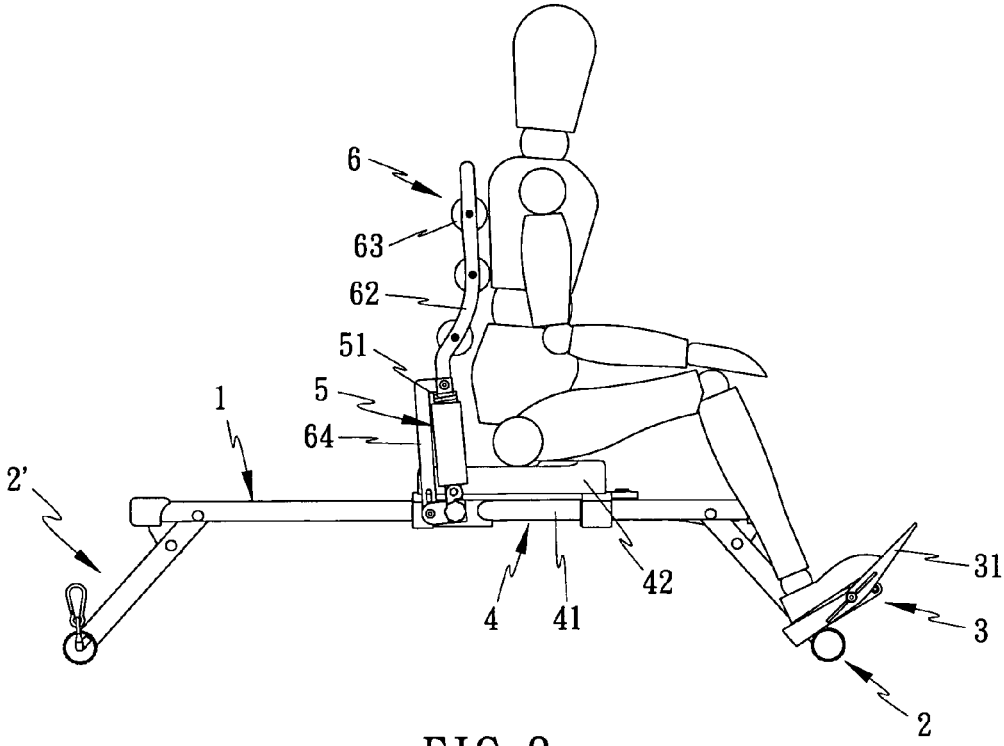
FIG. 8 is a schematic view showing a first motion produced in accordance with the present invention.

Referring to FIG. 8, while in operation, the user initially positions on the sliding seat assembly 4 and disposes his feet respectively on the footboards 3, which provides the feet to be against therefrom and hence applies the tractive force acting on the leg to result in the subsequent movement of the seat assembly 4. Simultaneously, the tension cords 15 disposed at the underside of the sliding section 41 generates a resistant force in time of the backward movement of the seat assembly 4, so as to exercise the muscle in the thigh.

Figure 9:
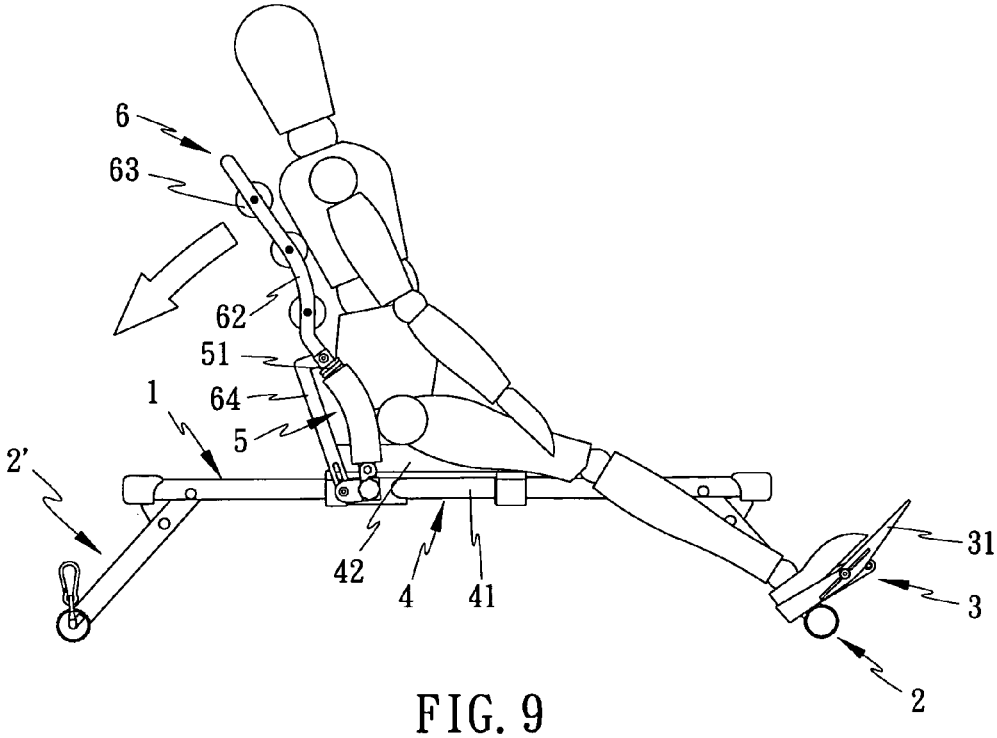
FIG. 9 is a schematic view showing a second motion produced in accordance with the present invention.

Besides the thigh exercise, the user can be positioned supine on the seat back 6 as illustrated in FIG. 9 by his lower torso, and the spring devices 5 engaged to the seat back 6 imparts a resistant force toward the supine force which thence sit-ups are performed to exercise the muscles of the waist and the stomach part. To the security consideration, the braces 64 restrict the beveled angle while lying on the seat back 6 to maintain the standard posture in exercise, thereby effectively training the muscles in the abdominal region.

Figure 10:
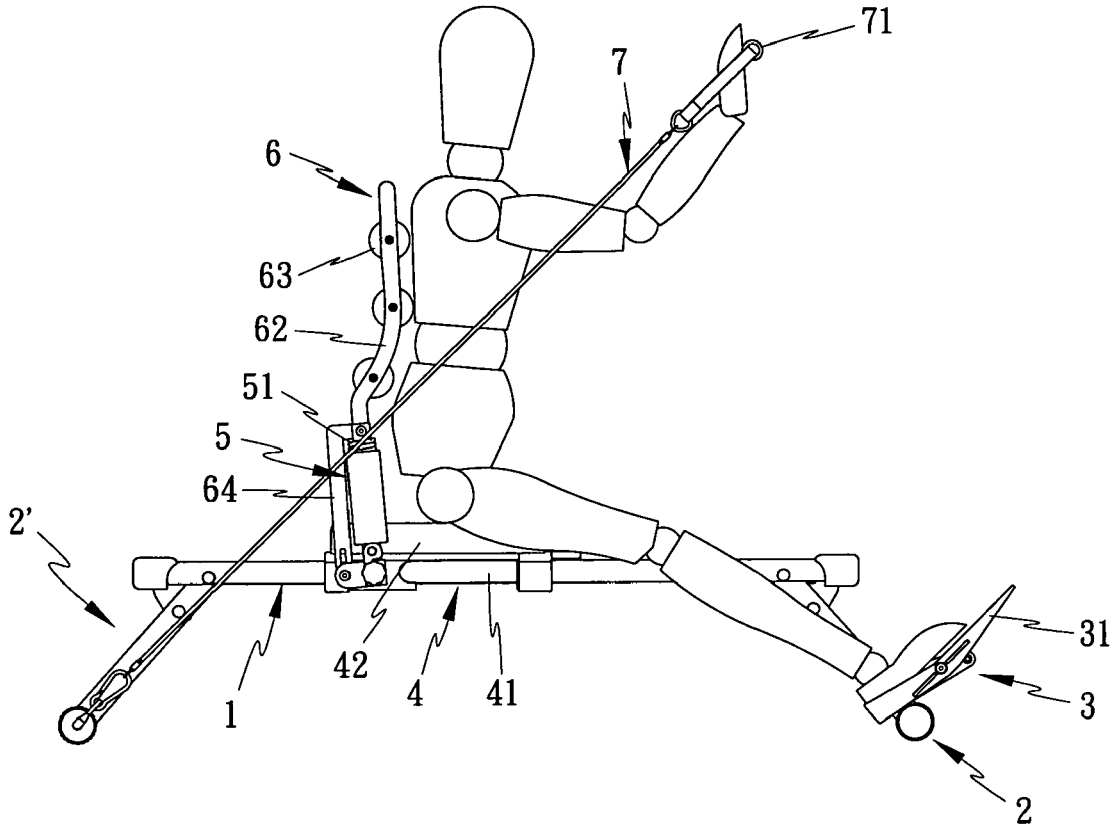
FIG. 10 is a schematic view showing a third motion produced in accordance with the present invention.

Both referring to FIGS. 1 and 10, two pulling devices 7 with handlebars 71 are separately mounted on both sides of the rear frame 2' which permits the user grasping the handlebars 71 and pulling the devices 7 going forward in order to exercise the arms' muscles. Hence, according the above three operating motions, the present invention not only exercises the muscles of the thigh and arms but also provides the sit-ups performance to train the waist and abdominal regions, thereby increasing the exercise effect.

While we have shown and described the embodiment in accordance with the present invention, it should be clear to those skilled in the art that further embodiments may be made without departing from the scope of the present invention.

What is claimed is:

1. A multi-function exercise apparatus comprising:

a support platform;

a pair of footboards with two respective pedals attached to said support platform;

a sliding seat assembly having a seat cushion fastened to a sliding section, and said sliding section slidingly mounted to said support platform, said sliding section provides with a sliding base mounted on said support platform and a fastening section disposed on said base which includes two separate protrusions extending from both sides of said base and a pivotal socket connected to an outer edge of each said protrusion;

two spring devices respectively secured to both sides of said sliding seat assembly and each of which comprising a spring, a first stem affixed to a top end of said spring and a second stem attached to a lower end thereof; said second stem connected to said sliding seat assembly; said spring device is installed to said pivotal socket; and a seat back pivoted to said two first stems of said spring devices to bend said spring while imparting a supine force to said seat back, by which a resistant force can be generated against said supine force further wherein each said protrusion has a pivotal plate disposed thereon and said seat back has two respective braces fastened to bottoms of said two arms; each said brace forms a slot at its distal end so as to contact with said pivotal plate.

2. The multi-function exercise apparatus as claimed in claim 1, wherein, said seat back consists of a bracket presented in a "Γ" contour and two arms of said bracket separately attached to said two first stems of said spring devices.

3. The multi-function exercise apparatus as claimed in claim 2, wherein, a plurality of spherical rotors are mounted between said two arms of said bracket.

4. The multi-function exercise apparatus as claimed in claim 1, wherein, each of said spring devices has a shield disposed around an outer peripheral thereof.

5. The multi-function exercise apparatus as claimed in claim 1, wherein, a pulley assembly is located at one end of said support platform and a fixed portion is located at the other end thereof; at least one tension cord with its end connects to said fixed portion, thence to said pulley assembly, and then attaches to said sliding seat assembly.

6. The multi-function exercise apparatus as claimed in claim 1, wherein, said support platform has a front frame and a rear frame separately attached thereto.

* * * * *